US005447753A

United States Patent [19]

Noda et al.

[11] Patent Number: 5,447,753

[45] Date of Patent: Sep. 5, 1995

[54] METHOD OF MANUFACTURING COATED PAPER FOR PRINTING

[75] Inventors: Toshiyuki Noda, Tokyo; Natsuo Fujisaki, Ishinomaki, all of Japan

[73] Assignee: Nippon Paper Industries Co., Ltd., Tokyo, Japan

[21] Appl. No.: 233,893

[22] Filed: Apr. 22, 1994

Related U.S. Application Data

[63] Continuation of Ser. No. 894,738, Jun. 5, 1992, abandoned.

[30] Foreign Application Priority Data

Jun. 7, 1991 [JP] Japan ..... 3-136765

[51] Int. Cl.[6] ..... B05D 5/00; B05D 3/00; B05D 1/30; B05D 1/36

[52] U.S. Cl. ..... 427/296; 427/420; 427/411; 427/326; 427/350; 427/428

[58] Field of Search ..... 427/294, 296, 326, 350, 427/420, 411, 428

[56] References Cited

U.S. PATENT DOCUMENTS

| | | | |
|---|---|---|---|
| 2,186,957 | 1/1940 | Collings et al. | 427/350 |
| 2,279,553 | 4/1942 | Bradt | 427/296 |
| 2,748,886 | 6/1956 | Wildebour | 427/356 |
| 2,866,499 | 12/1958 | Haley | 159/6.2 |
| 3,082,144 | 3/1963 | Haley | 427/296 |
| 3,303,816 | 2/1967 | Lauring | 427/420 |
| 3,462,290 | 8/1969 | Kresse et al. | 427/420 |
| 4,230,776 | 10/1980 | Kosaka | 428/537 |
| 4,348,248 | 9/1982 | Poncet | 427/350 |
| 4,520,048 | 5/1985 | Ranger | 427/350 |
| 4,571,279 | 2/1986 | Oizumi et al. | 427/411 |
| 4,737,383 | 4/1988 | Matsumae et al. | 427/294 |
| 5,055,320 | 10/1991 | Miura et al. | 427/430 |
| 5,395,644 | 3/1995 | Affinito | 427/294 |

FOREIGN PATENT DOCUMENTS

| | | |
|---|---|---|
| 2832071 | 1/1980 | Germany . |
| 49-24133 | 6/1974 | Japan . |
| 49-35447 | 9/1974 | Japan . |
| 54-74761 | 6/1979 | Japan . |
| 54-85811 | 7/1979 | Japan . |
| 58-62637 | 4/1983 | Japan . |
| 3-086273 | 4/1991 | Japan . |
| 982757 | 2/1965 | United Kingdom . |

OTHER PUBLICATIONS

James P. Casey; Pulp and Paper; Chapter 31: Hot-Melt Coating; pp. 2533–2535; 2537–2539; 2557–2558. (1983) no month available.

*Primary Examiner*—Diana Dudash
*Attorney, Agent, or Firm*—Burns, Doane, Swecker & Mathis

[57] ABSTRACT

A coating method characterized in that a coating liquid including a pigment and a binder, and having a concentration of between 50 and 70% by weight and a viscosity of between 700 and 4000 cps, is deaerated in an environment having a degree of vacuum of a saturated vapor pressure or less and under a condition of applying shear to the coating liquid, and a printing base paper is coated with the deaerated coating liquid having the curtain-like shape to produce a coated paper for printing and having a superior white paper brightness, smoothness, uniform coating quantity, and printing suitability.

18 Claims, 2 Drawing Sheets

METHOD OF MANUFACTURING COATED PAPER FOR PRINTING

This application is a continuation of application Ser. No. 07/894,738, filed Jun. 5, 1991, now abandoned.

BACKGROUND OF THE INVENTION

1. Field of the Invention

This invention relates to a method of manufacturing a coated paper for printing. More particularly, the present invention relates to a method of manufacturing a coated paper for printing and having a coating face giving a superior suitability for printing.

2. Description of the Related Art

Japanese Examined Patent Publications (Kokoku) No. 49-24133 and No. 49-35447 disclose a curtain type coating method comprising a step of forming a free-falling curtain of a coating liquid, and a step of making the free-falling curtain collide with a supporting body, i.e., a coating base paper, to thus coat the paper, and it is well known that this method is suitable for providing a very thin thickness of the coating liquid and a very high processing speed.

A blade type coating method, a bar type coating method and a reverse-roll type coating method currently are mainly used as a method of manufacturing a common coated paper to be used for printing. In the two former methods, an excess quantity of the coating liquid is applied on the coating base paper and then the excess coating liquid is scraped off by a blade or a bar to obtain a desirable quantity of the coating liquid. In the reverse-roll type coating method, a coating liquid picked up by a coating roll is metered by a metering roll to obtain a desirable quantity of the coating liquid, and then the desirable quantity of the coating liquid is transferred to a coating base paper.

Nevertheless, an improvement of the quality of the coated paper for printing is urgently required, and thus the following problems with the above conventional coating methods have arisen.

Namely, a streak is generated on the coated paper due to an abrasion or a staining of a blade in the blade type coating method, which lowers the quality of the coated paper. Also, since the blade must be often replaced in this method, the operational efficiency of this method is poor. Also, the coating quantity is changed according to an irregularity of a surface of the coating base paper, and thus an unevenly coated surface often occurs. Accordingly, it is difficult to obtain a superior printing face of the coated paper. Further, this method has a drawback in that, when operational conditions are not suitable, the blade scrapes the surface of the coating base paper and the coating liquid is removed from the coating base paper in such a manner that fibers constituting the coating base paper are exposed at convex portions thereof. A composition of the coating liquid used in the blade type coating method must be kept at a level at which a viscosity of the coating liquid under the blade and subjected to shearing does not reach too high a value, to prevent generation of streaks, and thus a specific limitation of the characteristics of a pigment, an adhesive or the like, and a blending condition thereof, is required, and thus it is difficult to improve the quality, or lower the cost of manufacturing, of the coated paper.

Next, the bar (rod) type coating method has a limitation of a viscosity of the coating liquid used, and accordingly, it is extremely difficult to uniformly coat a coating liquid having a high viscosity on a coating base paper without a generation of coating irregularities. Further, this method has a drawback in that a quantity of the coating liquid to be coated depends largely on the viscosity and a concentration thereof, and thus it is impossible to freely change the quantity to be coated.

In the reverse-roll type coating method, a ratio between a surface speed of a coating roll and a surface speed of a metering roll must be successively changed according to the characteristics of a coating liquid, to thus obtain a desirable quantity of the coating liquid, and this procedure is very complicated. A nip space between the coating roll and the metering roll must be kept within an extremely narrow range, such as 0.025 mm to 0.62 mm, with a high precision, and thus a complicated apparatus and operation are required. Further, it is extremely difficult to obtain a coating surface having no irregularities by this method, and thus there is a limitation of a viscosity and a concentration of the coating liquid capable of be used in this method. Furthermore, when a solid foreign material is mixed in the coating liquid, the foreign material is apt to clog the space between the coating roll and the metering roll, and thus portions to which the coating liquid is not transferred are generated.

A curtain type coating method has been proposed for utilization in various applications. Namely, Japanese Unexamined Patent Publication (Kokai) No. 54-85811 discloses a utilization thereof in the manufacture of a pressure-sensitive copy paper, and Japanese Unexamined Patent Publication (Kokai) No. 54-74761 discloses the utilization thereof in the manufacture of a thermosensitive copy paper. Further, the curtain type coating method has been used in a process of wax coating a paper board. Nevertheless, the blade type coating method, the bar type coating method or the reverse roll type coating method is now commonly used for the manufacturing of a coated paper.

A reason why the curtain type coating method cannot be commonly applied to the coated paper is that a concentration and a viscosity of the coating liquid used for a coating paper to be used in printing cannot be lowered, due to problems regarding a quality of a final product and a consumption of drying energy. For example, a viscosity of the coating liquid used for the manufacture of the pressure-sensitive copy paper and the thermalsensitive copy paper is between 100 cps and 400 cps, but a coating liquid having a viscosity of 1000 cps and 4000 cps is used for the manufacture of the usual coated paper, and therefore, if this coating liquid is directly used in the curtain type coating method for the usual coated paper, uncoated portions caused by bubbles in the coating liquid are generated on the coated face, and the thus-generated bubble traces are elongated by a difference between a coating speed and a falling speed of the coating liquid to a length several times the size of the bubbles in the coating liquid. The generation of such elongated traces is a very serious problem when a high speed coating process, such as a process used for manufacturing the coating paper to be used for printing is adopted.

SUMMARY OF THE INVENTION

An object of the present invention is to provide a method of manufacturing a coated paper to be used for printing and capable of maintaining a coating quality even if the coating process is applied for a long time at a high speed.

Another object of the present invention is to provide a method of manufacturing a coated paper to be used for printing and having a high quality such that a uniform coating layer not dependent on a topography of a surface of a coated base paper is provided, and an exposure of fibers constituting the paper from the paper, such as the fiber exposure generated when the coated surface is scrubbed by a blade, and coating irregularities are not generated.

A further object of the present invention is to provide a method of manufacturing a coated paper to be used for printing, whereby a stoppage of a machine for replacing a blade or a bar is eliminated and the application can be made at a high coating speed of 1000 m/min or more.

Another object of the present invention is to provide a method of manufacturing a coated paper to be used for printing, whereby a coating liquid having a composition such that a viscosity thereof reaches a high value during a high shear operation, to thereby eliminate a generation of streaks, can be coated.

A manufacture of a coated paper to be used for printing and using a curtain type coating method in accordance with the present invention is enabled by deaerating a coating liquid having a high concentration and a high viscosity and used when manufacturing a usual coated paper by a mass production method under a degree of vacuum of a saturated vapor pressure or less.

Namely, a method of manufacturing a coated paper to be used for printing, in accordance with the present invention, is characterized in that a coating liquid including at least one pigment and at least one binder and having a concentration of between 50% by weight and 70% by weight and a viscosity of between 700 cps and 4000 cps is deaerated in an environment having a degree of vacuum of a saturated vapor pressure or less and under a condition of applying shear to the coating liquid, the coating liquid is formed as a free-falling curtain in a vertical direction and a printing base paper is coated with the deaerated coating liquid so that the free-falling curtain of the coating liquid collides with the coating base paper running continuously in a direction crossing the free-falling curtain. Preferably, a deaeration ratio of bubbles having a diameter of between 0.01 mm and 0.5 mm in the coating liquid is 90% or more, and further preferably, a paper having a smoothness of 50 sec or more, as measured by a BEKK smoothness tester, is used as a coating base paper. Furthermore, a coating base paper having an undercoating layer applied by a blade type coating method or a roll type coating method is preferably used. A method in accordance with the present invention preferably includes a suctioning of an air retained in cavities of a surface of the coating base paper, from a back side of the coating base paper, just before, simultaneously, or just after the coating treatment.

The viscosity in the present invention is expressed by a value measured at the temperature of 25° C. by a B type viscometer having a #3 spindle speed of 60 r.p.m., unless otherwise specified.

DESCRIPTION OF THE PREFERRED EMBODIMENTS

Figure 1:
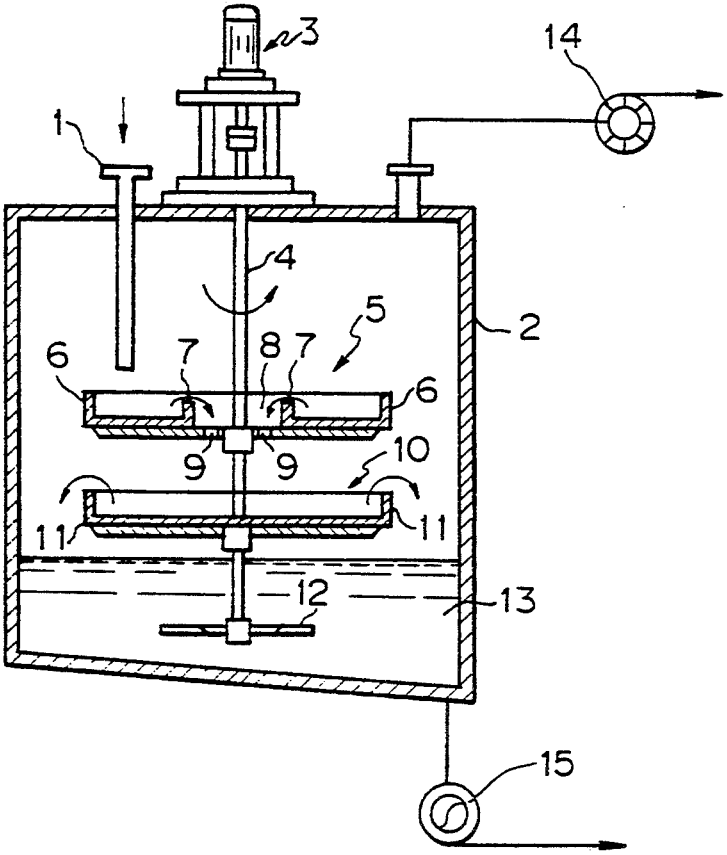
FIG. 1 is an explanatory front view of a continuous vacuum deaeration apparatus.

In the present invention, a pigment such as a kaolin, a talc, a calcium carbonate, a titanium dioxide, a satin white, a plastic pigment or the like, and a binder such as a styrene butadiene latex, a starch, a volyvinyl alcohol, a polyvinyl acetate, a carboxymethyl cellulose or the like, are used to constitute the coating liquid. In addition to the above material, if necessary, an additive such as a dispersant, a lubricant, or a water retention agent may be used. A concentration of the coating liquid is between 50% by weight and 70% by weight, preferably 60% by weight and 65% by weight, taking into consideration the quality of the coated paper and the energy cost required for drying the coated paper. A viscosity of the coating liquid is between 700 cps and 4000 cps. Further, the pigment is used at a ratio of two to twenty times that of the quantity of binder used.

A first method of improving a printing suitability of the coated face in the present invention is to deaerate a coating liquid at a degree of vacuum of a saturated vapor pressure or less, and under a condition of applying a shear to the coating liquid. Currently, when a deaeration of a coating liquid for a coated paper to be used for a printing is necessary, a cyclone type deaeration apparatus is generally used, but small bubbles having a diameter of between around 0.01 mm and 0.2 mm cannot be removed sufficiently by this deaeration apparatus, and thus the deaeration ratio of the bubbles is only around 80%.

As described before, the reason why the deaeration of the bubble in the coating liquid for the coated paper to be used for the printing is difficult is that the viscosity and the concentration of the coating liquid are much higher than those of coating liquids used for manufacturing a thermosensitive copy paper and a pressure-sensitive copy paper. Namely, the viscosity of the coating liquid is 100 cps to 400 cps for the thermosensitive copy paper and the pressure-sensitive copy paper and 1000 cps to 4000 cps for the coated paper to be used for the printing, and the concentration of the coating liquid is 20% by weight to 45% by weight for the thermosensitive copy paper and the pressure-sensitive copy paper and 50% by weight to 70% by weight for the coated paper to be used for the printing. Various pigments, such as kaolin, calcium carbonate or the like are used in the coating liquid, and such pigments has complicated shapes and include many bubbles, and thus when the pigments are dispersed in water, the bubbles are not easily separated from the pigments. Further, such bubbles have an extremely small volume, and thus the number of bubbles is enormous. Accordingly it is impossible to trap all of the bubbles by using the cyclone type deaeration apparatus.

A stability of the bubble depends largely on the viscosity. Namely, the viscosity of the coating liquid used for the coated paper to be used for the printing is 1000 cps to 4000 cps when measured by a B type viscometer having a #3 spindle speed of 60 r.p.m., but when the measurement is conducted by the viscometer having a spindle speed of 6 r.p.m., the viscosity of the coating liquid becomes to 10000 cps to 30000 cps, and such values show that the viscosity of the coating liquid has a high non-Newtonian flow in a lower shear region. Accordingly, when the bubbles in the coating liquid rise to the surface of the liquid, a rising speed thereof in a coating liquid having a high viscosity in this lower shear region becomes remarkably slow. Namely, a measured speed is between 0 to 0.5 mm/min. Further, since the coating liquid includes the pigment in a high concentration, a movement of the bubbles is obstructed by the pigment. Furthermore, the bubbles are also included in the pigment, and accordingly the difficulty in the deaeration of bubbles is doubled.

In the present invention, the deaeration operation is conducted at a degree of vacuum of a saturated vapor pressure or less and under a condition of applying a shear to the coating liquid. To bring the coating liquid used to manufacture a coated paper to be used for the printing and having the high viscosity to a boiling state, in the present invention the degree of vacuum must be a vacuum below a saturated vapor pressure at a temperature of the liquid, for example, a vacuum of 20 Torr or less, preferably 10 Torr or less, when a temperature of the coating liquid in the vacuum deaeration apparatus is 18° C.

When the degree of vacuum is raised, a volume of gas is increased and evaporated water also increased. Therefore a pumping speed of a vacuum unit must be increased compared with that of a conventional vacuum unit of a lower vacuum. This requirement is satisfied by a vacuum unit assembled to a water sealed pump in which a lowering of the pumping speed is small at a high degree of vacuum with a Roots type pump. For the following manufacturing example, it is possible to attain a large volume pumping ability by directly connecting the Roots type pump having an ability of 1500 l/min (10 Torr) and 1.5 kW to the water sealed pump having an ability of 2400 l/min (150 Torr) and 3.7 kW. Since an air of from several % to several ten % of the coating liquid is included therein, an ability corresponding to a quantity of the air and a quantity of a vapor evaporated from the air is required as the pumping ability. Namely, the pumping ability is determined by a temperature of the coating liquid, the degree of vacuum, a quantity of the coating liquid to be treated, and an air content in the coating liquid. Accordingly, it is possible to reduce the necessary degree of vacuum and the pumping speed by raising the temperature of the coating liquid, but this may lead to an undesirable influence on the coating liquid, and thus preferably the deaeration is conducted at a temperature near to the normal coating temperature.

Figure 2:
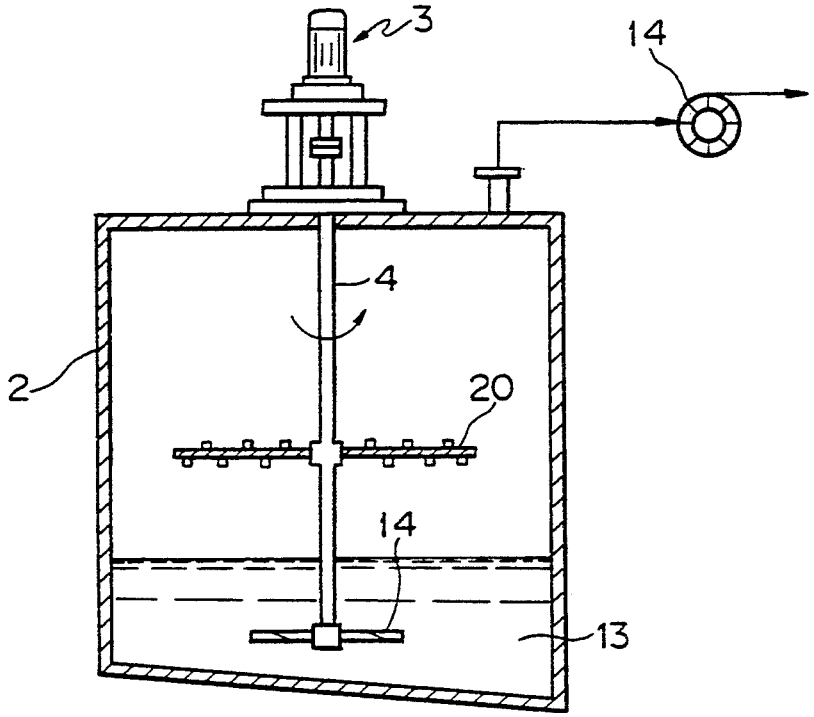
FIG. 2 is an explanatory front view of a batch type vacuum deaeration apparatus.

The apparatuses shown FIGS. 1 and 2 and described in detail hereafter, and a continuous vacuum Deaeration Apparatus supplied by the Koruma Co., Germany, can be used as the deaeration apparatus. Particularly, a vacuum vessel is provided with a stirring device in the Koruma Deaeration Apparatus, and thus the bubbles can be easily brought to the surface of the coating liquid. In this apparatus, the coating liquid is supplied on a dispersing plate rotating at a high speed, to apply a strong shear operation to the coating liquid, and thus the coating liquid is blown up as a thin membrane by centrifugal force. Namely, in this apparatus, a dispersing plate a diameter of which is improved from 500 mm to 600 mm is arranged in the vacuum vessel having a diameter of 700 mm, and rotated at a high speed of 1450 r.p.m., and the coating liquid is supplied to a center portion of the dispersing plate. Four circular screen plates having different diameters i.e., 300 mm, 400 mm, 500 mm or 600 mm, but having the same width, 110 mm, are concentrically arranged in a vertical posture on the dispersing plate. A great number of holes having a diameter of 0.8 mm are arranged on the circular screen plate, and when the coated liquid is blown up from the center of the dispersing plate by centrifugal force, the bubbles of the coating liquid pass through the holes and are broken.

A preferable second means of improving the printing suitability of the coated face in the present invention is to remove air retained in a plurality of cavities of a coating base paper. If these small units of air are not removed, the small units are covered with a membrane of the coating liquid and then enter a drying zone. In this drying process, the small units are blown out from the membrane, and thus uncoated portions having a creater-like shape remain on the coated face. A trace of the bubbles, based on the bubbles in the coating liquid, has an elongated shape, but a shape generated by the above small units is substantially circular.

To prevent generation of the latter drawback, it is preferable to use a coating base paper having a smoothness improved by a calendering process. Namely, a conventional coating base paper used for manufacturing a coated paper to be used for the usual printing has a BECK smoothness of between 20 sec and 30 sec, preferably a BECK smoothness of 50 sec or more, most preferably 200 sec or more. A smoothing treatment is conducted by using a conventional multi-stage calender composed of an elastic roll, a soft nip calender using a heat roll, a calender using a metal roll or the like to obtain a printing base paper having an improved smoothness. A printing base paper having an under coating layer applied with a blade type coating process or a bar type coating process may be used in place of the coating base paper having the improved smoothness. In the latter case, a coating liquid having a similar pigment and composition to those a coating liquid used for a curtain type coating process in accordance with the present invention may be used, and it is preferable to coat the under coating layer having a weight per unit area of between 3 $g/m^2$ and 8 $g/m^2$. A large irregularity, such as a wave on a surface of the printing base paper can be eliminated by applying the under coating layer by the blade type coating process, the bar type coating process, or the roll type coating process, and thus, even if the coating base paper has a large surface irregularly, it is possible to provide a uniform surface suitable for applying the curtain-type coating layers having an uniform coating quality to the coating base paper. Further, it is preferable to apply the smoothing treatment on the coating base paper having the under coating layer.

A most effective method of lowering the above by using the double coating process is to immediately apply the curtain type coating process after applying the under coated layer, without a drying process. This is because, when the curtain type coating process is applied on a coating face still in a wet state from the under coating process, it is easy to remove an air layer on the under coating layer by a coating layer of the curtain type coating process, and thus the latter coating layer can be broadly spread on the surface of the under coating layer. Namely, the wet under coating layer has extremely superior wetting characteristics due to a presence of a liquid on the surface, and thus the above drawback can be easily eliminated. Further, when the under coating layer is dried, an irregular face is often generated by an evaporation of a water content in a pigment, and accordingly, it is preferable to keep the under coating layer in the wet state, to maintain the smooth surface of the under coating layer, and thus it is possible to reduce an air layer between the under coating layer and the coating layer applied by the curtain type coating process. Further, it may be suitable to constitute the under coating layer of several layers.

A coating liquid including a pigment may be used for the under coating layer, but it is possible to use a starch, a vinyl alcohol, a latex, or a carboxymethylcellulose and a blended liquid those of. When those binders are used in the under coating layer, it is possible to improve a pick (surface) strength, which is a problem when printing the paper manufactured by using the curtain type coating process.

A preferable third means of improving the printing suitability of the coated paper is to suck air at a position near to a point at which a curtain membrane of a free-falling coating liquid falls on the coating base paper from a back side of the coating base paper when the curtain membrane collides with the coating base paper, to remove defects caused by micro cavities of the coating base paper. The air is blown simultaneously, just before or just after that the curtain membrane collides with the coating base paper from the back side of the coating base paper. It is preferable to arrange a slit-like suction portion having a width of between 0.3 mm and 10 mm along a line at which the curtain membrane falls, to remove air between the curtain membrane and the coating base paper. A suction pressure is optionally adjusted to between 750 Torr and 600 Torr, according to a weight per unit area and an air peameability of the printing base paper.

Further, the curtain membrane may be continuously applied twice on the printing base paper in the present invention. When using this method, and since the bubbles in the coating liquid are extremely small, large defects are not generated on the coated face of the coated paper. This method is also useful for decreasing the micro craters caused by cavities in the coating base paper.

The deaeration operation is conducted at the degree of vacuum of a saturated vapor pressure or less and under a condition of applying a shear to a coating liquid. Namely, when the coating liquid enters a vessel kept in a vacuum state, water included in a water soluble coating liquid is evaporated and a flow caused by the evaporation of water is generated in the coating liquid, and thus the coating liquid is stirred by the flow and bubbles fixed to the pigment rise to the surface of the coating liquid. Since the coating liquid is applied with a shearing operation in this state, even if the viscosity of the coating liquid is high when a lower shearing operation is applied, it is possible to deaerate in a short time. Further, when the coating liquid is kept in the vacuum state, a floating power of the bubble is increased by an expansion of the bubbles in the coating liquid, and thus the bubbles can easily rise to the surface, to thereby enable an easy removal of fine bubbles from the coating liquid.

Further, it is possible to cover a micro cavity of the printing base paper or to remove air in the cavity by using a coating base paper having a high smoothness or a coating base paper having an under coated layer, or by sucking air from a back side of the coating base paper when applying a curtain type coating process. Accordingly by using the above means, it is possible to avoid a phenomenon that air included in the cavity and covered with the coating membrane is expanded in a drying process to be blown out from the coating embrance, with the result that an uncoated portion having a crater-like shape remains on a coated face of the coated paper.

The present invention will be described herein after in connection with the accompanying drawings showing examples of a vacuum deaeration apparatus preferably used to implement a manufacturing method of the present invention.

FIG. 1 is an explanatory view showing an example of a continuous deaeration apparatus. In this apparatus, a coating liquid to be subjected to a deaeration operation is continuously supplied from a nozzle 1 onto an upper rotatable pan 5 having a weir plate 6 at an outer circumference thereof. An opening portion 8 enclosed by another weir plate 7 is arranged in a center portion of the rotatable pan 4, and a coating liquid flows over the weir plate 7 and down through several holes 9 into a lower rotatable pan 10. A shaft 4 supporting the upper rotatable pan 5 and the lower rotatable pan 10 is rotated by a motor 3, and a shearing blade 12 is fixed to a lower end of the shaft 4. An inside of a tank 2 is brought to a vacuum condition expressed as the pressure of between 5 Torr and 20 Torr by a vacuum apparatus 14. Accordingly the coating liquid becomes foamed and bubbles having a greater shape in the coating liquid first fall down from the upper rotatable pan 5 to the lower rotatable pan 10, and at that time, the bubbles are broken. A coating liquid which is not foamed in the upper rotatable pan 4, i.e., the liquid having a large specific gravity, is moved to an outer portion in a radial direction of the upper rotatable pan 5 by centrifugal force, and does not fall from the upper rotatable pan 5.

The coating liquid falling on a center portion of the lower rotatable pan 10 is moved to an outer portion in a radial direction of the lower rotatable pan 10 by a spiral movement about the center of the pan 10, generated by a coriolis force generated by a centrifugal force and a viscosity of the coating liquid, and then the coating liquid flows over a weir plate 11 arranged at an outer circumference of the lower rotatable pan 10 and is accommodated in a lower portion of the tank 2. A shear operation is applied to a coating liquid 13 in the tank 2 by the stirring blade 12 and bubbles remaining in the coating liquid 13 rise to a surface of the coating liquid 13. The coating liquid to which the deaeration treatment is fully applied is exhausted from a lowermost portion of the tank 2 by an exhausting pump 15. In this apparatus, only a relatively wear shear operation is applied to the coating liquid, but it is possible to attain the deaeration of the coating liquid by shortening a short pass of the coating liquid and maintaining a retention time sufficient to raise the bubbles to the surface of the liquid. This apparatus has advantages in that maintenance of the apparatus is easy due to a relatively lower rotation of the pans, and that a structure of the apparatus is simple.

FIG. 2 is an explanatory view showing an example of a batch type deaeration apparatus. An inside of a tank 2 is brought to a vacuum by a vacuum apparatus 14, and a coating liquid is subjected with a shear operation by a stirring blade 20 rotating at a slow speed, e.g., around 2.5 r.p.m, and thus a raising movement of the bubbles is enhanced by the shear operation. The bubbles in the coating liquid are suddenly foamed by the shear operation and are incremented by the degree of vacuum, and a height of the bubbles is suddenly raised. The raised bubbles are broken by a bubble breaking blade 20.

Examples of the manufacturing of a coated paper for printing, i.e., a paper expressed in general as "A2 COAT", by using a coating liquid deaerated by the above-explained apparatus or an improved type of a deaeration apparatus supplied by KOROMA CO, Germany, in accordance with the present invention, will be described hereafter. In the description, a portion means a portion by weight.

Before describing the examples, definitions of evaluations used for evaluating the features of the examples, and a method of measuring the evaluations, will be described hereafter.

(1) Trace in which bubbles is broken (Broken Bubble Trace)

A trace formed on a coating face of a coating base paper by broken bubbles in a coating liquid is observed, and the presence of the trace is evaluated.

(2) Two Colour Printing Ability Evaluation

A yellow ink and a red ink, INK.TK mark V, for a leaf offset printing supplied by TOYO INK CO., are used. First, 0.3 ml of the yellow ink is applied to a roll of a RI printing machine and is printed in a surface of an obtained coated paper, and after 6 sec–7 sec of the above printing, the red ink is applied to a roll of the RI printing machine and is printed so that the red ink is coated on the yellow ink. A printing irregularity of the red ink and a coating irregularity of a coated layer of the paper are evaluated by a five point evaluation method. Note that the best evaluation is expressed as 5.

(3) Crater-like Trace Generated by Air Retained in a Cavity of a Coating Base Paper (Crater-like Trace)

Traces generated because a air retained in a cavity of a coating base paper is broken and having a crater-like shape are counted, and a number per 5 $mm^2$ of the coated face of the coated paper is used as an evaluating value.

EXAMPLE 1, AND COMPARATIVE EXAMPLES 1 AND 2

A blended liquid including 50 parts of kaolin, 50 parts of a calcium carbonate, 12 parts of SEB latex and 0.2 part of a dispersion agent is prepared, and a coating liquid is prepared by further adding 4 parts of a starch boiled by steam to the blended liquid stirred by a mixer. The coating liquid has a concentration of 62% by weight, and a viscosity of 2000 cps at a temperature of 22° C. and includes a great number of bubbles. A deaeration treatment applied to the coating liquid by using the batch type vacuum deaeration apparatus is carried out as follows.

A tank of the deaeration apparatus has an inner diameter of 800 mm and a height at 1000 mm. A coating liquid of 50 l is supplied for each batch, and a vacuum apparatus is activated. When the degree of vacuum reaches 20 Torr at a temperature of 25° C., the coating liquid suddenly foams and a great number of the bubbles are generated, and a height of the coating liquid including the bubbles is suddenly elevated. Then a valve is opened to return a pressure inside the tank to the atmospheric pressure, and after 12 minutes, the bubbles in a surface area of the coating liquid are successively broken under their own weight and a mechanical action of a bubble breaking blade, and thus the surface of the coating liquid starts to gradually sink down. After this state is continued for 35 minutes, most bubbles having a diameter of 0.05 mm or more are eliminated, and the viscosity of the coating liquid falls to 1800 cps.

A gravity, an air content of the coating liquid, and a deaeration ratio before and after application of the deaeration operation are measured, and the results shown in Table 1. For a comparision with the present invention, results using a conventional cyclone type deaeration apparatus are also shown, as a comparative example.

TABLE 1

| | | After Deaeration | |
|---|---|---|---|
| | Before Deaeration | Cyclone Deaeration | Vacuum Deaeration |
| Specific Gravity | 1.49 | 1.53 | 1.55 |
| Air Content (%) | 4 | 1.2 | 0.2 |
| Deaeration Ratio | — | 70 | 93 |

The coating liquid subjected to the deaeration treatment is supplied at a flow rate of 7 liter/min to an extrusion type curtain die having a slit width of 0.3 mm and a slit length of 500 mm, to make a free-falling curtain having a height of 15 cm, and the coating liquid in the curtain state is coated on a printing base paper having a weight per unit area of 90 $g/m^2$, a width of 430 mm and a BEKK smoothness of 20 sec, running at a speed of 1000 m/min, and dried in a state such that a content of water in a coated paper is controlled by a dryer having a temperature of between 100° C. and 180° C., to obtain a coated paper to be used for printing.

The obtained coated paper is a uniform dried solid having a weight per unit area of 14 $g/m^2$ and a covering formed from the coating liquid on a surface of the coated paper is uniform regardless of a topography of the printing base paper. Further, no streaks appear on the coated paper, and a brightness and a smoothness thereof are superior, as shown in Table 2.

A coated paper to be used for printing of a comparative example 1 is prepared by coating a deaerated coating liquid obtained by applying a cyclone type deaeration treatment to the same coating liquid as that used in the example 1, by using the curtain die. A coated paper to be used for a usual printing of a comparative example 2 is prepared by applying a blade type coating treatment to a coating liquid which is not subjected to the deaeration treatment. The qualities of the obtained coated papers of example 1, and comparative examples 1 and 2 are shown in Table 2.

TABLE 2

| | Example 1 | Comparative example 1 | Comparative example 2 |
|---|---|---|---|
| Brightness of white paper (%) | 60 | 60 | 52 |
| BEKK Smoothness (sec) | 1250 | 1100 | 950 |
| Trace of Broken Bubbles | NO | YES | NO |
| Evaluation of Two Colour Printing | 5 | 5 | 2 |

EXAMPLE 2, AND COMPARATIVE EXAMPLES 3 and 4

A coating liquid is prepared by blending 55 parts of kaolin, 45 parts of calcium carbonate, 8 parts of starch, 10 parts of SBR latex and 0.2 part of a dispersion agent. The coating liquid has a concentration of 60% by weight and a viscosity of 1800 cps at a temperature of 22° C. A deaeration treatment applied to the coating liquid by using the vacuum deaeration apparatus supplied by KORUMA CO., Germany, is as follows.

The coating liquid supplied to the deaeration apparatus is kept at the pressure of 15 Torr, and thus the bubbles in the coating liquid are deaerated to a desirable level. A deaeration ratio in this example is compared with that of a coating liquid prepared by using a conventional cyclone type deaeration apparatus, and the results are shown in Table 3.

TABLE 3

| | Before Deaeration | After Deaeration | |
|---|---|---|---|
| | | Cyclone Deaeration | Vacuum Deaeration |
| Specific Gravity | 1.46 | 1.52 | 1.55 |
| Air Content (%) | 4 | 1.2 | 0.2 |
| Deaeration Ratio | — | 70 | 93 |

The coating liquid subjected to the deaeration treatment is directly supplied at a flow rate of 9 liter/min from an exhausting pump of the vacuum deaeration apparatus to an extrusion type curtain die having a slit width of 0.3 mm and a slit length of 500 mm, to make a free-falling curtain having a height of 18 cm, and the coating liquid in the curtain state is coated on a printing base paper having a BEKK smoothness of 200 sec and running at a speed of 1200 m/min, to obtain a uniform dried solid having a weight per unit area of 14 g/m$^2$.

A coated paper to be used for a usual printing, of a comparative example 3, is prepared by coating a deaerated coating liquid obtained by applying a cyclone type deaeration treatment to the same coating liquid as that used in example 2, by using the curtain die. A coated paper to be used for a printing of a comparative example 4 is prepared by applying a blade type coating treatment to a coating liquid to which the deaeration treatment is not applied. The qualities of the obtained coated papers of the example 2, and the comparative examples 3 and 4 are shown in Table 4.

TABLE 4

| | Example 2 | Comparative example 3 | Comparative example 4 |
|---|---|---|---|
| Brightness of white paper (%) | 59 | 55 | 51 |
| BEKK Smoothness (sec) | 1300 | 1100 | 950 |
| Trace of Broken Bubbles | NO | YES | NO |
| Evaluation of Two Colour Printing | 5 | 5 | 2 |

In the comparative example 4 using the blade type coating treatment, a convex portion of the printing base paper becomes too thin due to a scrubbing of the coating liquid from the printing base paper, and thus fibers constituting the paper protrude from the paper, or streaks are generated on the coated face.

EXAMPLES 3 AND 4, AND COMPARATIVE EXAMPLES 5 AND 6

A coating liquid is prepared by dispersing 60 parts of kaolin, 40 parts of calcium carbonate, 5 parts of starch, 10 parts of SBR latex and 0.2 part of a dispersion agent into water. The coating liquid has a concentration of 62% by weight and a viscosity of 1950 cps at a temperature of 22° C. A great number of bubbles are included in the coating liquid, and therefore, a deaeration treatment is applied to the coating liquid by using a continuous vacuum deaeration apparatus shown in FIG. 1. A deaeration ratio in this example is compared with that of a coating liquid prepared by using a conventional cyclone type deaeration apparatus, and the results are shown in Table 5.

TABLE 5

| | Before Deaeration | After Deaeration | |
|---|---|---|---|
| | | Cyclone Deaeration | Vacuum Deaeration |
| Specific Gravity | 1.49 | 1.53 | 1.55 |
| Air Content (%) | 4 | 1 | 0.2 |
| Deaeration Ratio | — | 70 | 93 |

When the coating liquid is kept at the temperature of 20° C. and under a vacuum of a saturated vapor pressure or less of the coating liquid, i.e., the pressure of 20 Torr, the coating liquid reaches a boiling state and is sufficiently deaerated by applying a shear operation and thus bubbles in the coating liquid cannot be observed by the naked eye. The deaerated coating liquid is supplied to a curtain die having a slit width of 0.3 mm and a slit length of 500 mm, to make a free-falling curtain having a height of 15 cm, and is coated on a printing base paper having a BEKK smoothness of 20 sec and running at a speed of 900 m/min, to obtain the coated paper for printing of the example 3. Since the printing base paper used in the example 4 is a usual "COAT" paper having a BEKK smoothness of 20 sec, the obtained coated paper in the example 3 includes a great number of extremely small dots generated on the coating face by rolling air into cavities in the coating base paper.

To remove defects caused by the above small dots, a suction opening having a slit shape is arranged along the curtain membrane at a position opposite to the curtain nozzle and against the coating base paper. A coated paper for printing of example 4 is obtained by running the coating base paper above the suction opening supplied with suction force having the pressure of 710 Torr. In this case, air retained in the cavities of the coating base paper is sucked out, and the coating liquid is simultaneously sucked in, and thus the cavities are buried by the coating liquid and the above defects are removed. Further, a pick strength of the coating face is improved by this treatment. An effect of the decrease in the number of defects is shown in Table 6, and as shown in Table 6, the number of relatively large defects is made small by this treatment.

A coated paper to be used for a usual printing of a comparative example 5 is prepared by coating a deaerated coating liquid obtained by applying a cyclone type deaeration treatment to the same coating liquid as that used in example 3, by using the curtain die. A coated paper to be used for a usual printing of a comparative example 6 is prepared by applying a blade type coating treatment to a coating liquid to which the deaeration treatment is not applied. The qualities of the obtained coated papers of the examples 3 and 4, and the comparative examples 5 and 6 are shown in Table 6.

TABLE 6

| | Example 3 | Example 4 | Comparative example 5 | Comparative example 6 |
|---|---|---|---|---|
| Brightness of White Paper (%) | 60 | 57 | 60 | 52 |
| BEKK Smoothness (sec) | 1300 | 1200 | 1100 | 990 |
| Trace of Broken Bubbles | NO | NO | Great Number | No |
| Crater-Like Trace generated | 6 | 0 | 6 | 0 |

TABLE 6-continued

| | Example 3 | Example 4 | Comparative example 5 | Comparative example 6 |
|---|---|---|---|---|
| by Air (Over 0.1 mmϕ) | | | | |
| Crator-like Trace generated by Air (Between 0.01 mmϕ and 0.1 mmϕ) | 20 | 8 | 20 | 7 |
| Evaluation of Two Colour Printing | 5 | 5 | 5 | 3 |

EXAMPLES 5 AND 6, AND COMPARATIVE EXAMPLES 7 AND 8

A coating liquid is prepared by dispersing 60 parts of kaolin, 40 parts of calcium carbonate, 5 parts of starch, 12 parts of SBR latex, and 0.2 part of a dispersion agent water. The starch is first boiled with steam and then blended with the other materials. The coating liquid has a concentration of 58% and a viscosity of 1200 cps at a temperature of 22° C. A great number of bubbles are included in the coating liquid, and therefore, a deaeration treatment is applied to the coating liquid by using the same vacuum deaeration apparatus as that used in the example 2, i.e., KORUMA type Apparatus. The coating liquid is supplied at a speed 8 liter/min, and thus bubbles in the coating liquid cannot be observed by the naked eye. The coating liquid in this example is deaerated under the pressure of 10 Torr.

The coating liquid is coated in the same manner as that of the example 3 on a printing base paper having a BEKK smoothness of 50 sec, to obtain a coated paper for a usual printing of an example 5. Further, the same coating liquid is supplied to a dual slot die capable of simultaneously making two coating membranes to form two raws of free-falling curtains having a distance of 50 mm therebetween. The two curtains of coating liquid fall onto a printing base paper running in a direction transversing the two curtains at a speed of 1200 m/min, to obtain a coated paper of an example 6. The printing base paper has a width of 430 mm and a weight per unit area of 64 g/m$^2$. A dried solid amount of the coated layer is 11 g/m$^2$.

A coated paper to be used for a usual printing of a comparative example 7 is prepared by coating a deaerated coating liquid obtained by applying a cyclone type deaeration treatment to the same coating liquid as that used in example 5, by using the curtain die. A coated paper to be used for a usual printing of a comparative example 8 is prepared by applying a blade type coating treatment to a coating liquid to which the deaeration treatment is not applied. The qualities of the obtained coated papers of the examples 5 and 6, and the comparative examples 7 and 8 are shown in Table 7.

TABLE 7

| | Example 5 | Example 6 | Comparative example 7 | Comparative example 8 |
|---|---|---|---|---|
| Brightness of White Paper (%) | 59 | 58 | 59 | 51 |
| BEKK Smoothness (sec) | 1250 | 1250 | 1150 | 990 |
| Trace of Broken Bubbles | NO | NO | Yes | NO |
| Crater-Like Trace generated by Air (Over 0.1 mmϕ) | 1 | 0 | 6 | 0 |
| Crator-like Trace generated by Air (Between 0.01 mmϕ and 0.1 mmϕ) | 8 | 7 | 20 | 7 |
| Evaluation of Two Colour Printing | 5 | 5 | 5 | 3 |

The coated paper of example 6 has a superior brightness of white spaces on the paper, and the smoothness and the evaluation of the two color printing, and the traces of broken bubbles caused by the bubbles in the coating liquid, are minute. Although the suction treatment for the back side of the coating base paper is not used in example 6, the number of minute defects caused by air in the cavities of the printing base paper is reduced.

EXAMPLE 7, AND COMPARATIVE EXAMPLES 9 AND 10

A coating liquid to be used for an under coating treatment is prepared by dispersing 60 parts of kaolin, 50 parts of calcium carbonate, 7 parts of starch, 8 parts of SBR latex, and 0.2 part of a dispersion agent in water. This component is the same as that of a coating liquid used in a conventional blade type coating treatment. This coating liquid for the under coating treatment has a concentration of 64% by weight and a viscosity of 3000 cps. The coating liquid is coated in such a manner that a dried solid is made 7 g/m$^2$ on a coating base paper having a BEKK smoothness of 20 sec by a blade type coating method, and then a coated paper is dried.

Next, a coating liquid to be used for a second coating treatment is prepared by dispersing 60 parts of kaolin, 40 parts of calcium carbonate, 5 parts of starch, 12 parts of SBS latex and 0.2 part of a dispersion agent 10 in water. This coating liquid for the second coating treatment has a concentration of 61% by weight and a viscosity of 1500 cps at a temperature of 22° C. The second coating liquid is deaerated by the same treatment as that used in example 2 and the deaerated coating liquid is coated on the same face as that coated with the undercoating layer, of the printing base paper, by the same curtain nozzle as used in the example 2 to obtain a coated paper for printing. A dried solid is applied by the curtain type coating method at 7 g/m$^2$.

A coated paper to be used for a usual printing of a comparative example 9 is prepared by coating a deaerated coating liquid obtained by applying a cyclone type deaeration treatment to the same coating liquid as that used in example 7, by using the curtain die. A coated paper to be used for a usual printing of a comparative example 10 is prepared by applying a blade type coating treatment to a coating liquid to which the deaeration treatment is not applied. The qualities of the obtained coated papers of the example 7, and the comparative examples 9 and 10 are shown in Table 8.

TABLE 8

| | Example 7 | Comparative example 9 | Comparative example 10 |
|---|---|---|---|
| Brightness of white | 60 | 60 | 52 |

TABLE 8-continued

| | Example 7 | Comparative example 9 | Comparative example 10 |
|---|---|---|---|
| paper (%) | | | |
| BEKK smoothness (sec) | 1150 | 1100 | 950 |
| Trace of Broken Bubbles | NO | Great Number | NO |
| Crater like Trace generated by Air (over 0.1 mmϕ) | 0 | 6 | 0 |
| Crater like Trace generated by Air (Between 0.01 mmϕ and 0.1 mmϕ) | 7 | 20 | 7 |
| Evaluation of Two Colour Printing | 5 | 5 | 3 |

The qualities of the coated paper of example 7 are for superior in total characteristics, including the white paper brightness, the smoothness, the evaluation of two colour printing, and the micro defects on the coated face and caused by cavities of the printing base paper or the like.

A coated paper for printing and having a superior white paper brightness, smoothness and a uniform coating quality can be obtained by the manufacturing method of the present invention. Further, it is possible to remarkably improve a printing suitability by the manufacturing method of the present invention.

More specifically, an effect of the present invention can be enhanced when a large amount of a pigment i.e., two to twenty times the amount of a binder, is used.

When applying the manufacturing method in accordance with the present invention, the quality of the obtained coated paper is further improved by using a coating base paper having a BEKK smoothness of 50 sec or more, or a coating base paper with an undercoating layer, or by applying a suction treatment to a back side of the coating base paper.

We claim:

1. A method of manufacturing a coated paper to be used for printing, comprising the steps of:

deaerating an aqueous coating liquid including at least one pigment and at least one binder and having a concentration of pigment and binder between 50% and 70% by weight and a viscosity of between 700 and 4,000 cps in an environment having a degree of vacuum of a saturated water vapor pressure or less and under a condition of applying shear to the coating liquid, to produce dearated coating liquid, forming said coating liquid into a free falling curtain, and coating a printing base paper with the dearated coating liquid such that the free falling curtain of the coating liquid collides with the printing base paper running continuously in a direction crossing the free-falling curtain.

2. A method of manufacturing a coated paper according to claim 1, wherein at least 90% of the bubbles having a diameter of between 0.01 mm and 0.5 mm in the coating liquid are removed during the deaeration step.

3. A method of manufacturing a coated paper according to claim 1 wherein a paper having a Bekk smoothness of 50 sec or more is used as the printing base paper.

4. A method of manufacturing a coated paper according to claim 1, further comprising applying an undercoating layer by a coating method selected from a group consisting of a blade coating method or a roll coating method.

5. A method of manufacturing a coated paper according to claim 1, wherein air retained in a surface of the printing base paper is sucked from a back side of the printing base paper before the coating step.

6. A method according to claim 2, wherein the printing base paper has a Bekk smoothness of 50 seconds or more.

7. A method of manufacturing a coating paper according to claim 2, further comprising applying an undercoating layer by a coating method selected from a group consisting of a blade coating method and a roll coating method.

8. A method of manufacturing a coated paper according to claim 1, wherein air retained in a surface of the printing base paper is sucked from a back side of the printing base paper simultaneously with the coating step.

9. A method of manufacturing a coated paper according to claim 2, wherein air retained in a surface of the printing base paper is sucked from a back side of the printing base paper before the coating step.

10. A method of manufacturing a coated paper according to claim 3, wherein air retained in a surface of the printing base paper is sucked from a back side of the printing base paper before the coating step.

11. A method of manufacturing a coated paper according to claim 4, wherein air retained in a surface of the printing base paper is sucked from a back side of the printing base paper before the coating step.

12. A method of manufacturing a coated paper according to claim 6, wherein air retained in a surface of the printing base paper is sucked from a back side of the printing base paper before the coating step.

13. A method of manufacturing a coated paper according to claim 7, wherein air retained in a surface of the printing base paper is sucked from a back side of the printing base paper before the coating step.

14. A method of manufacturing a coated paper according to claim 1, wherein air retained in a surface of the printing base paper is sucked from a back side of the printing base paper after the coating step.

15. A method of manufacturing a coated paper according to claim 1, wherein the forming and coating steps are conducted at atmospheric pressure.

16. A method of manufacturing a coated paper according to claim 2, wherein the forming and coating steps are conducted at atmospheric pressure.

17. A method of manufacturing a coated paper according to claim 1, wherein in the coating step, the coating liquid is applied over an undercoating layer while the undercoating layer is in a wet state.

18. A method of manufacturing a coated paper according to claim 17, wherein the forming and coating steps are conducted at atmospheric pressure.

* * * * *